US005833182A

United States Patent [19]

Maus

[11] Patent Number: 5,833,182

[45] Date of Patent: Nov. 10, 1998

[54] ADJUSTABLE COLUMN

[75] Inventor: Holger Maus, Bettendorf, Germany

[73] Assignee: Stabilus GmbH, Koblenz, Germany

[21] Appl. No.: 939,519

[22] Filed: Sep. 29, 1997

[30] Foreign Application Priority Data

Oct. 2, 1996 [DE] Germany ..... 196 40 738.9

[51] Int. Cl.[6] ..... A47C 3/30

[52] U.S. Cl. ..... 248/161; 267/131; 297/344.15

[58] Field of Search ..... 248/631, 161, 248/162.1, 404, 188.5; 297/344.19; 267/131

[56] References Cited

U.S. PATENT DOCUMENTS

| | | | |
|---|---|---|---|
| 4,245,826 | 1/1981 | Wirges | 297/344.19 X |
| 4,756,826 | 7/1988 | Hosan et al. | 297/344.19 X |
| 4,940,202 | 7/1990 | Hosan et al. | 297/344.19 X |
| 4,969,619 | 11/1990 | Bauer et al. | 248/161 |
| 5,462,248 | 10/1995 | Bauer et al. | 248/161 |
| 5,531,413 | 7/1996 | Wolf et al. | 248/404 X |
| 5,702,083 | 12/1997 | Lai | 297/344.19 X |

FOREIGN PATENT DOCUMENTS

| | | |
|---|---|---|
| 0366889B1 | 11/1993 | European Pat. Off. . |
| 7623283 | 1/1977 | Germany . |
| 8524341 | 12/1985 | Germany . |
| WO9603065 | 2/1996 | WIPO . |

*Primary Examiner*—Derek J. Berger
*Attorney, Agent, or Firm*—Baker & Botts, L.L.P.

[57] ABSTRACT

A longitudinally adjustable column for chairs, tables or the like, comprising a vertical tube and a longitudinal adjusting element arranged inside the tube. The longitudinal adjusting element has a cylinder with an axially movable piston rod, and is mounted on a base plate which is held in place inside the tube. The base plate is held in place on one side by an inwardly-bent deformation of the vertical tube, and on the other side by at least one supporting surface on the inner wall of the vertical tube. The deformation is formed by bending a face at one end of the tube in the direction of the inner wall of the tube, so that the outer wall of the tube rests against one side of the base plate.

6 Claims, 2 Drawing Sheets

ADJUSTABLE COLUMN

BACKGROUND OF INVENTION

This invention relates to a longitudinally adjustable column for adjustably supporting chairs, tables or the like, and more particularly, to a longitudinally adjustable column with an improved construction for reducing unwanted chattering and vibration.

Adjustable guide columns for chairs are well known in the art. For example, a guide column for the stepless height adjustment of chair seats is disclosed in German Utility Model Gm 7,623,283. In this guide column, a base used as a supporting surface is fixed to the guide column between a deformation bent inwardly at right angles, and a circumferential crimp on the inner wall of the guide column. Because the base, which constitutes a simple disk, is naturally subject to unwanted variations in thickness resulting from manufacturing, problems arise in rigidly affixing the base to the guide column. If the edges of the base are not sufficiently thick, for example, there may be insufficient pre-stress between the base and the guide column, which may result in unwanted movement of the base with respect to the guide column. This unwanted movement in turn can cause unwanted chattering or vibration of the base against the guide column.

The guide columns disclosed in German Utility Model Gm 8,524,341 and in European Patent No. EP 0,366,889 B1 also suffer from unwanted chatter and vibration resulting from the base moving with respect to the guide column. Additionally, European Patent No. EP 0,366,889 B1 notes another problem with prior art guide columns, namely that the face which is bent over to form the deformation must be very flat in order for the base to be properly positioned at right angles to the vertical tube.

SUMMARY OF INVENTION

It is an object of the present invention to provide a guide column using a simple and effective means of fastening a base plate within a vertical tube forming a guide column, notwithstanding unwanted variations in the thickness of the base plate. It is a further object of the present invention to provide such a guide column which eliminates the problems of chattering and vibration found in the prior art. It is a still further object of the present invention to provide such a guide column which also is simple and economical to produce.

In accordance with the present invention, a longitudinally adjustable column is provided which tightly affixes a base plate within a vertical tube so as to eliminate unwanted movement between the base plate and the vertical tube, and thereby eliminate unwanted chatter and vibration. The adjustable column of the present invention eliminates unwanted chatter and vibration even in the presence of unwanted variations in the thickness of the base plate. The adjustable column of the present invention is also simple and economical to produce.

The present invention securely mounts the base plate within the vertical tube by bending the face of the end of the vertical tube inwardly toward the direction of the inner wall of the tube to a degree sufficient to cause the base plate to be fixed in place against the outer wall of the bottom end of the vertical tube. In bending the face of the end of the tube, the present invention provides a far greater angle of deformation than does the prior art, which in turn provides much improved rigidity. With the type of fastening provided by the present invention, imperfections in the flatness of the face at the end of the tube will not affect the level of secureness with which the base plate is fixed within the tube.

To assemble the base plate into the vertical tube, the base plate is first placed within the tube against at least one supporting surface located on the inner wall of the tube near one end of the tube. This assembly may be performed with the end of the tube receiving the base plate pointing upward, for example. The deformation rigidly fixes the base plate between the deformation and the one or more supporting surfaces in such a way that unwanted chattering and vibration is prevented.

In an advantageous embodiment, the deformation is formed so that the face of the end of the tube rests against the inner wall of the tube. The deformation provided by this embodiment is a closed bead having especially high strength. The deformation may be formed using mechanized power equipment, because the maximum force encountered during the deformation process occurs when the face of the end of the tube makes contact with the inner wall of the tube.

In another embodiment, in order to provide an especially simple deformation process, the cross-sectional shape of the deformation may be circular. This deformation may be initiated and completed by a single die and a deforming tool. A very simple die having a short deforming radius may be used so that the tube can easily be removed from the device once the deformation process is completed.

In another embodiment, the deformation may be performed so that the width of the completed deformation is greater than the height of the deformation. Such a deformation may be formed by modifying a deformation having a circular shape.

An additional benefit provided by the present invention includes an especially large load bearing area provided for the base plate.

It has been found to be particularly advantageous to, prior to the deformation process, reduce the thickness of the wall at the end of the vertical tube in the region which will be bent to form the deformation. When the thickness of the wall is so reduced, the deformation process is made easier, and the spring-like characteristics of the deformation are enhanced, which in turn is especially effective in eliminating the unwanted vibration and chattering known in the prior art.

A further advantage is realized when the reduction in wall thickness is implemented by increasing the inside diameter of the tube, without altering the outside diameter of the tube. When the reduction in wall thickness is performed this way, a shoulder is formed on the inner wall of the tube, which shoulder can serve as the supporting surface for the base plate. Supporting surfaces formed by crimping or other methods become unnecessary. dr

BRIEF DESCRIPTION OF THE DRAWINGS

Other objects, features and advantages of the invention will become apparent, and its construction and operation better understood, from the following detailed description when read in conjunction with the accompanying drawings, in which.

DETAILED DESCRIPTION OF THE PREFERRED EMBODIMENT

Figure 1:
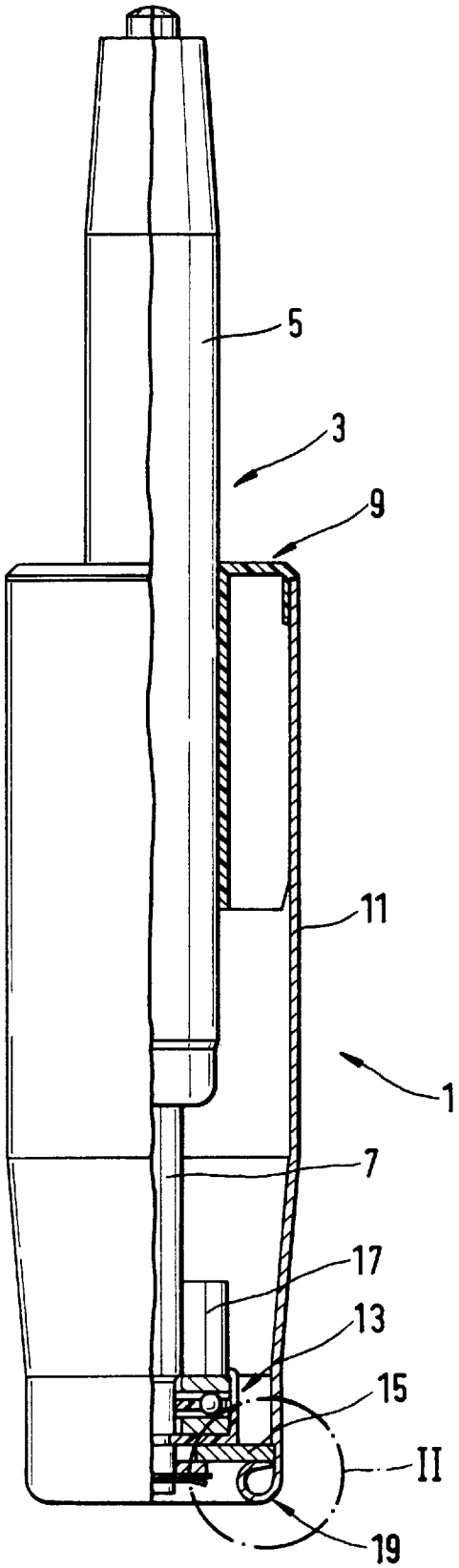
FIG. 1 depicts a partial cut-away view of the longitudinally adjustable column of the present invention.

FIG. 1 depicts a longitudinally adjustable column 1 for tables, chairs or the like. The longitudinally adjustable column 1 comprises a longitudinal adjusting element 3, which has a cylinder 5 with an axially movable piston rod 7. A pneumatic, hydropneumatic or mechanical assembly, as are disclosed in German Pat. No. GM 7,623,283 or in WO 96/03065, may be used as the longitudinal adjusting element 3. The longitudinal adjusting element 3 is mounted inside a vertical tube 11. A guide bushing 9 centers the cylinder 5 within the vertical tube 11.

The piston rod 7 is axially fastened to the vertical tube 11 by a base plate 15, but may turn relative to the vertical tube 11 by way of an axial bearing 13. If desired, a bumper 17 may be used as positioning stop. The base plate is fixed to the vertical tube 11 by a deformation 19, which is shown in additional detail in FIG. 2.

Figure 2:
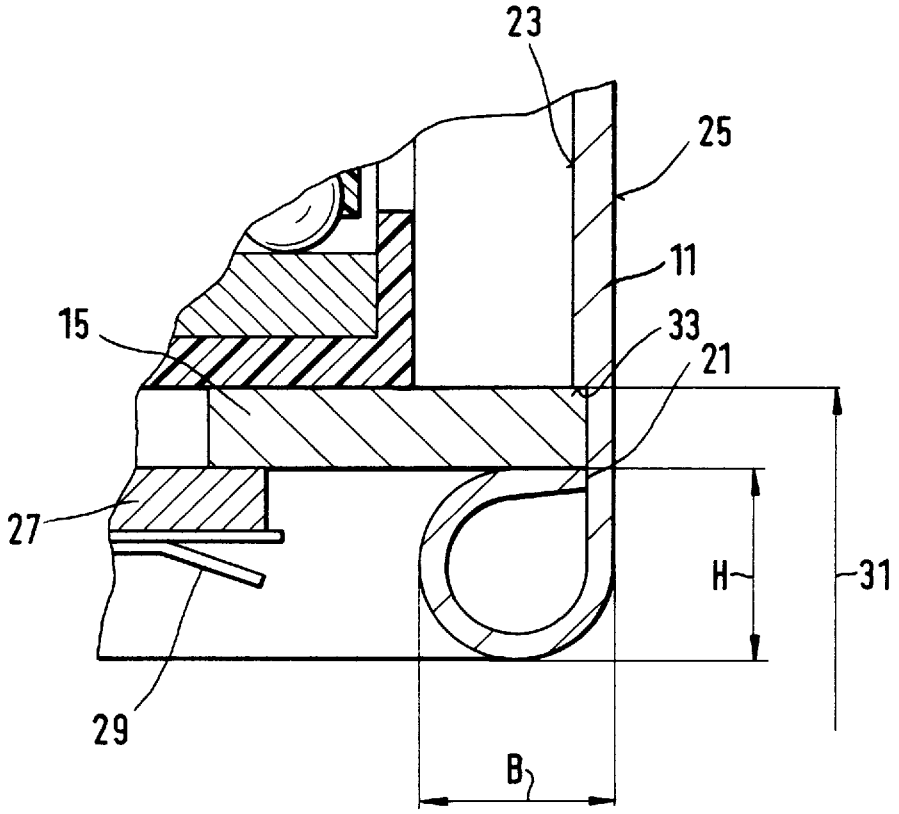
FIG. 2 depicts a more detailed view of the deformation in the longitudinally adjustable column depicted in FIG. 1.

Referring now to FIG. 2, it can be seen that the deformation 19 at the end of the vertical tube 11 has a total angle which is greater than 180°, and is formed so that a face 21 is turned in the direction of an inner wall 23 of the vertical tube 11, and also so that the base plate 15 rests on an outer wall 25 of the tube. Depending upon the embodiment, the deformation may constitute a closed annular bead such that the face 21 is in contact with the inner wall 23.

The cross-section of deformation 19 typically may be circular in shape, as depicted in FIG. 2. The deformation 19 is formed with a particular bending radius and in such a way so that the outer wall 25 of vertical tube 11 contacts the base plate 15 while the deformation is in progress, and so that the outer wall of the base plate 15 slides with pre-stress in the direction of the inner wall 23 of vertical tube 11.

The piston rod 7 is held in place by a disk 27 in conjunction with a securing clamp 29. For aesthetic reasons, it may be desirable for the axial height "H" of the deformation 19, as depicted in FIG. 2, to be greater than the combined height of the disk 27 and the securing clamp 29, so that the disk 27 and the securing clamp 29 are visually obscured. To obtain the maximum load bearing area between base plate 15 and outer wall 25 of vertical tube 11, it may be desirable to form the deformation 19 so that the width "B" of the deformation is greater than the axial height "H" of the deformation, as depicted in FIG. 2. Since the deformation 19 as depicted in FIG. 2 is generally circular in shape, any desired height-to-width ratio for the deformation may be obtained by modifying the shape of the circular deformation to obtain the desired shape.

In a preferred embodiment, the vertical tube 11 has a wall thickness reduction 31 formed by removing material from its inner wall 23, beginning at the location of base plate 15. The wall thickness reduction 31 forms a shoulder on the inner wall 23 of vertical tube 11, which is available as a supporting surface 33 for the base plate 15. The wall thickness reduction 31 permits the deformation 19 to be effected more easily and, in addition, causes the completed deformation 19 to possess a characteristic springiness which is particularly effective in eliminating undesirable chattering and vibration.

The present invention can be manufactured by first producing the supporting face 33 on inner wall 23, by a wall thickness reduction 31 for example. The vertical tube 11 is then placed in a holding device, typically with the end of the vertical tube 11 which is to be deformed pointing upward. The base plate 15 is then placed on the supporting surface 33, and the deformation 19 is created by bending the face 21 inward and toward inner wall 23 so that outer wall 25 comes into contact with base plate 15, thereby clamping the base plate 15 between the deformation 19 and the supporting surface 33. It is unimportant whether the outer wall 25 supports the base plate 15 at its outermost edge or at some point between its outer edge and its center. Variances in the thickness of base plate 15 likewise will not have any effect on the present invention.

While the invention has been described herein by reference to preferred embodiments thereof, it will be understood that such embodiments are susceptible to variation and modification without departing from the inventive concepts disclosed.

I claim:

1. A longitudinally adjustable column, comprising:

a vertical tube forming a housing and having a longitudinal axis, a radial axis, a top end, a bottom end having a face, an inner wall and an outer wall, said inner wall having at least one supporting surface located proximate to said bottom end of said tube;

a longitudinally adjustable element mounted inside said tube along said longitudinal axis of said tube, said adjustable element having a cylinder with an axially movable piston rod disposed within said cylinder; and a base plate mounted inside said tube proximate to said bottom end of said tube and along said radial axis of said tube, said base plate having a top surface and a bottom surface, wherein said longitudinally adjustable element is mounted to said top surface of said base plate, and wherein said base plate is mounted to said tube with said top surface fixed against said supporting surface on said inner wall of said tube, and with said bottom surface fixed against a deformation of said tube, said deformation being formed by bending said face of said bottom end of said tube in an inward direction so that said outer wall of said tube is fixed against said bottom surface of said base plate, thereby fixing said base plate between said deformation and said supporting surface on said inner wall of said tube.

2. The longitudinally adjustable column according to claim 1 wherein said deformation of said tube causes said face of said bottom end of said tube to rest against said inner wall of said tube.

3. The longitudinally adjustable column according to claim 1 wherein said deformation of said tube is approximately circular in shape.

4. The longitudinally adjustable column according to claim 1 wherein said deformation of said tube is characterized by a height extending in the direction of said longitudinal axis of said tube and a width extending in the direction of said radial axis of said tube, and wherein said width of said deformation is greater than said height of said deformation.

5. The longitudinally adjustable column according to claim 1 wherein there is a reduction in the distance between said inner wall and said outer wall of said tube at said bottom end of said tube which is bent to form said deformation.

6. The longitudinally adjustable column according to claim 5 wherein said tube is characterized by an inside diameter, and wherein said reduction in the distance between said inner wall and said outer wall of said tube is formed by increasing said inside diameter at said bottom end of said tube, thereby forming a shoulder on said inner wall of said tube, said shoulder forming said supporting surface on said inner wall of said tube.

* * * * *